US006039261A

United States Patent [19]

Pavese

[11] Patent Number: 6,039,261

[45] **Date of Patent: *Mar. 21, 2000**

[54] PROCESS FOR IMPROVING THE COMBUSTION OF A BLOW-TYPE BURNER

[76] Inventor: Guy Pavese, 5 rue du Gal de Gaulle, Kirchheim-67520 Marlenheim, France

[ * ] Notice: This patent is subject to a terminal disclaimer.

[21] Appl. No.: 07/764,737

[22] Filed: Sep. 24, 1991

[30] Foreign Application Priority Data

Sep. 24, 1990 [FR] France ..... 90-11907

[51] Int. Cl.[7] ..... F23N 1/08

[52] U.S. Cl. ..... 236/14; 431/2; 431/4

[58] Field of Search ..... 431/2, 3, 4, 8; 110/342, 345; 236/14

[56] References Cited

U.S. PATENT DOCUMENTS 4,295,816 10/1981 Robinson ..... 431/4

4,368,035 1/1983 McCartny et al. ..... 431/4 X 4,538,981 9/1985 Venturini ..... 431/4 X 4,737,101 4/1988 Palmer ..... 431/12

*Primary Examiner*—Edward G. Favors

*Attorney, Agent, or Firm*—Schwartz & Weinrie

[57] ABSTRACT

A method and apparatus for achieving optimal combustion. A boiler has a blower-type burner operatively associated therewith wherein the burner has a variable speed blower. Combustive air is provided to the burner, and in accordance with the invention, a gaseous combustion-correcting complex is provided for supplying a plurality of gaseous additives to the combustive air of the burner. A plurality of sensors are disposed within the boiler and burner, and within a discharge outlet of the boiler, and a central unit is operatively connected to the sensors for receiving information signals therefrom. In response to the information signals received from the sensors, the central unit controls the speed of the variable speed blower and the operation of the gaseous combustion-correcting complex for providing predetermined amounts of the additives to the combustive air.

15 Claims, 2 Drawing Sheets

PROCESS FOR IMPROVING THE COMBUSTION OF A BLOW-TYPE BURNER

FIELD OF THE INVENTION

The present invention relates to a process for improving the combustion of a blower-type burner.

More particularly, the invention envisages a combustion process improved as far as energy output and pollution reduction are concerned, by means of a gaseous catalyst with the assistance of a programmable calculator, or any other "intelligent" device.

It applies to all types of blower-type burners employing a power boiler for domestic, collective, or industrial use, and using diverse combustibles: fuel oil, gas, or other fuels utilized by boilers of such a type.

The present invention envisages primarily an improved combustion, having as its aim to create optimal combustion conditions.

OBJECTS AND SUMMARY OF THE INVENTION

It is an object of the invention to correct the combustion process, so as to improve its energy output by a continuous admixture of a complex fluid reacting exothermally, in an amount suitably dosed and controlled, so as, on one hand, to continuously establish conditions of an optimal and most complete combustion, and, on the other hand, to reduce any unburnt volatile residue to a very low value.

The present invention also envisages a clean combustion process.

So as to take environmental concerns into account, the best possible industrial combustion process should be accompanied by a continuous control of the quantity and nature of the residue. Such a control should also be able to continuously regulate the general combustion conditions, so as to effect either a necessary reduction of the noxious residue to a low level, their neutralization, or their appropriate transformation.

The present invention has as its simultaneous goals the two aforementioned objects of improvement in the energy output, and to establish conditons of clean combustion.

The present invention aims equally to operatively maintain optimal conditions of combustion for an extended amount of time, by continuously monitoring and if necessary, correcting the aforementioned conditions.

For this purpose the optimal combustion process, according to the present invention, is characterized by continuous correction of the combustion process, by injecting into the combustible air flow a variable dosed and controlled feed of a catalytic and correcting gaseous complex, the correction being obtained by varying the velocity of the blower associated with the burner, in accordance with the principal combustion parameters prevailing within the gas and within the combustion fumes, and the operation of the boiler.

According to another chararacteristic of the invention, provision is made for monitoring dirt accumulation in the boiler, and the admixture of the gaseous catalyzer fluid, as well as that of corrective residue-cleaning means.

According to another characteristic of the invention, provision is also made for monitoring the initially outgoing- and subsequent return-temperatures of the heat-energy carrying fluid.

Apart from the principal advantages of improvement in the energy output and creation of inoffensive residues, or, in any and all cases creation of products at least less noxious for the environment, the invention has numerous additional advantages, justifying even further use thereof:

- a sensible reduction of the dirt-accumulation of the boiler and chimneys,
- an important reduction in the generation of incombustible volatile residues,
- obtaining of longer intervals between maintenance schedules of the boiler, and clean-up of chimneys; lighter and less noxious fumes,
- economy in the use of combustibles,
- proper combustion; soot is transformed into gray powder,
- less corrosion and increased burner life,
- notable reduction of polluting residues,
- easy adaptability of machinery and equipment to current regulations or rules.

However, the passage of gases and fumes emitting lower noxious contents into the atmosphere, or being transformed into less noxious environment-injuring components, according to the process of the present invention, does not yet constitute a commercially justifiable advantage in our modern world. It should nevertheless be considered as one of the most important realizable advantages of the process, according to the present invention.

BRIEF DESCRIPTION OF THE DRAWINGS

The technical characteristics and other advantages of the invention are contained in the following description, shown by way of a non-limiting example of an implementation mode, and having reference to the annexed figures, in which.

DETAILED DESCRIPTION OF THE PREFERRED EMBODIMENT

Figure 1:
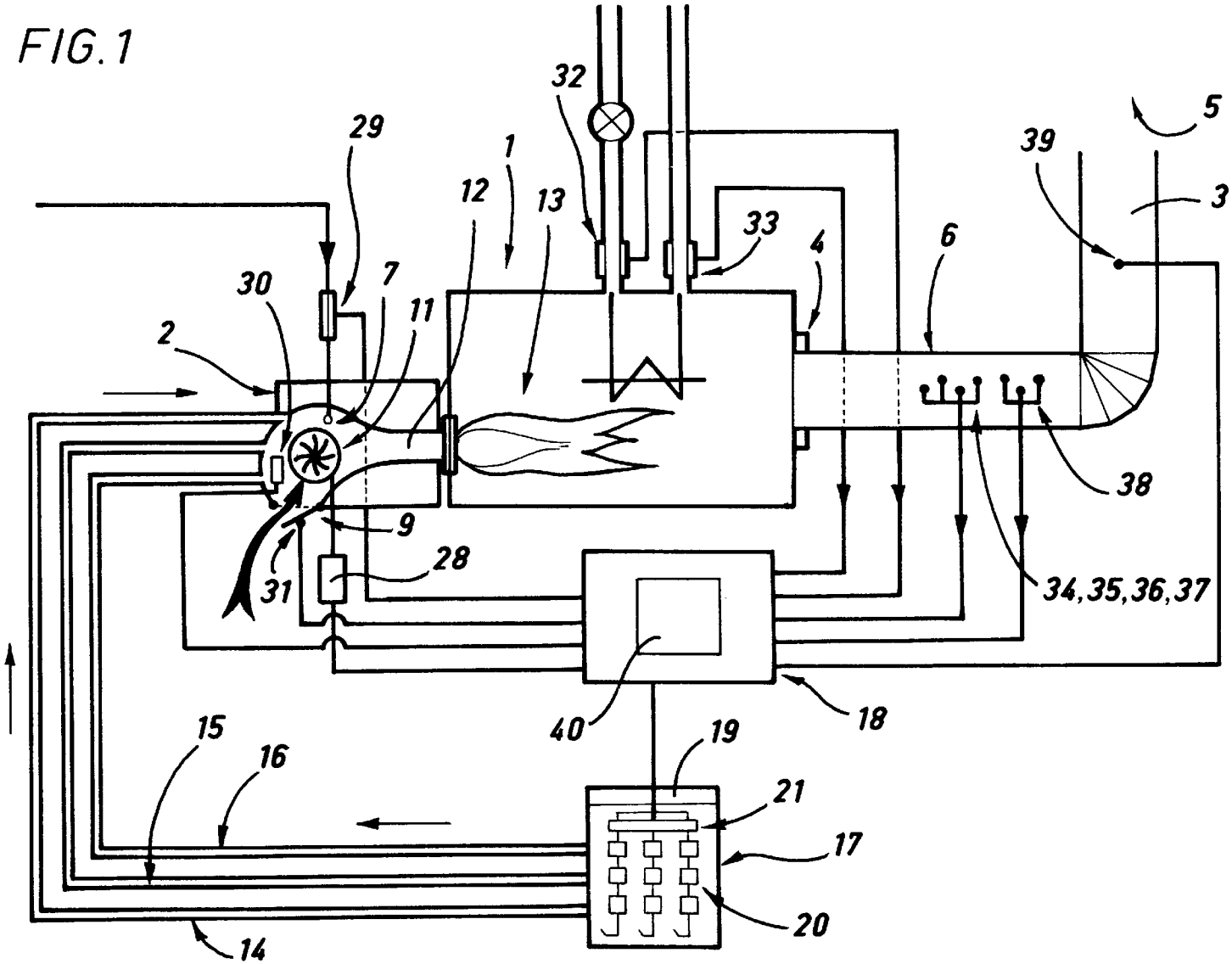
FIG. 1 is a general installation schematic, showing the connections between the different component parts thereof.
Figure 3:
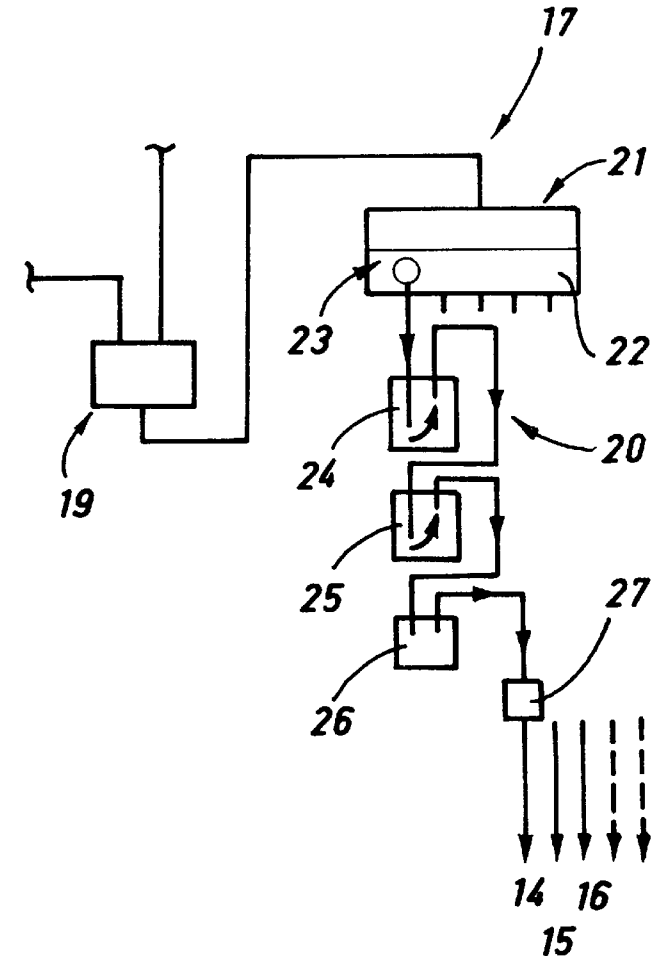
FIG. 3 is a schematic illustrating the general composition of the generator of the gaseous complex of correction.
Figure 2:
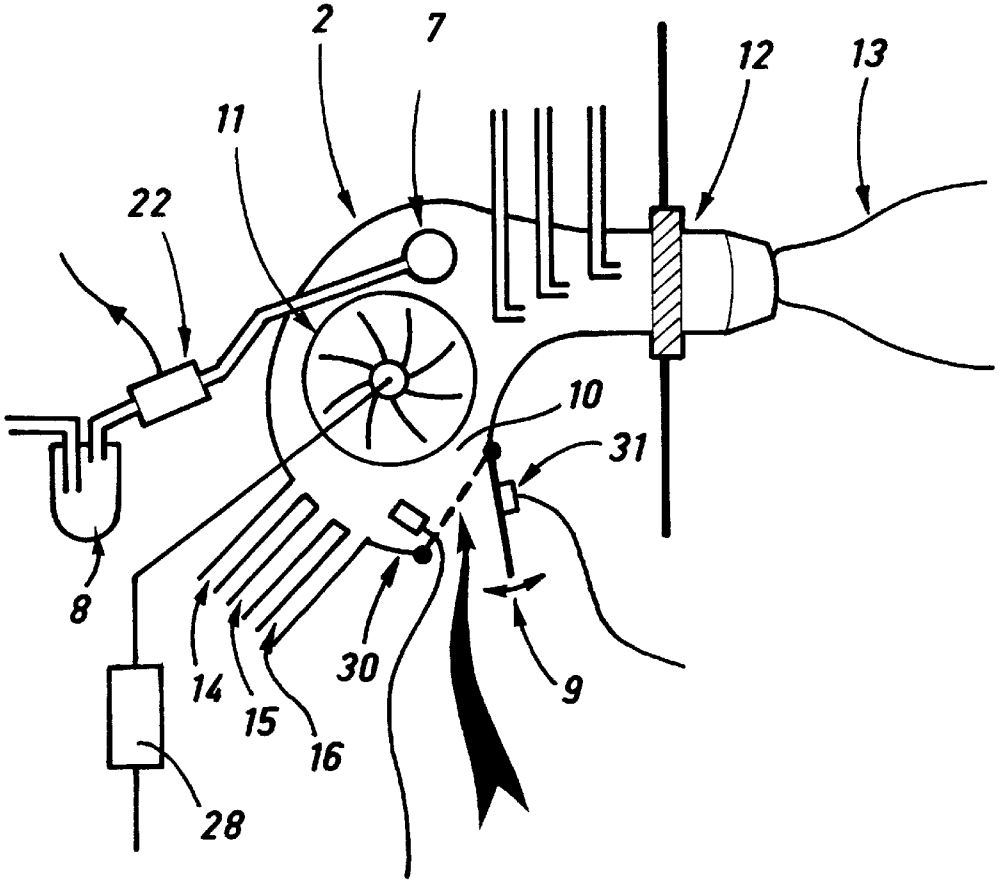
FIG. 2 is a schematic view of the apparatus of the present invention, connected to a boiler.

The method of improving combustion, according to the present invention, starts from the general inventive idea, which is to maintain, during the entire operation of the burner, optimal combustion conditions, by varying the flow of air entering the combustion process, and by adding to the above-noted air flow a variable dosed and controlled flux of a complex gaseous catalyzer; the variation of this flux is controlled by a central unit, in accordance with the values of the principal combustion components contained in the gas and combustion fumes, and also with the general variables of the operation of a boiler.

According to another characteristic of the invention, the velocity of the blower associated with the burner is varied, so as to modify the air flow entering the combustion process, i.e. any excess air, so as to correct and adapt accordingly both the combustion and the flow of the gaseous catalyzer, with a view of reducing formation of polluting and corrosive products, which furthermore are advantageously neutralized.

In order to realize this process, the central unit for the optimal combustion process includes various analyzers and circuits, in order to determine the values of physical parameters measured with the aid of different respective sensors and probes.

In a non-exhaustive manner the following parameters can be cited:

the flow of the combustible air, the sensor for the above-noted flow of combustible air, the entry temperature of the burning gas, the starting- and return-temperatures of the heat-carrying fluid, the characteristics of the combustion gas, i.e.:

temperature of the smoke, opacity of the smoke, oxygen contents, carbon oxide contents, nitrogen oxide contents, sulphur oxide contents.

So as to co-ordinate, guide, and control operation of the assembly, a programmable regulator-calculator, or any other intelligent system is set up to receive the various diverse and necessary informations, and to thereafter control the blower associated with the burner, taking into account operation of the burner furnace.

The method, according to the present invention, applies in particular to regulation of an existing boiler designed to control the start-up and heat-control of burners of the so-called "monobloc" type. It relates to burners, where the air damper is operated mechanically to assume the position of the flap-valve or entry vane of the fuel by controllable cam means, rod systems, or other mechanical means. In these types of burners the air/combustible-fuel ratio is constant, and corresponds to the setting adopted at the time of discharge control. Any excess air does not follow the variation of atmospheric conditions, and the burner appears to be operated as if it were regulated by a single atmospheric parameter.

These types of burners attain a power output of the order of 10,000 thermal units.

In what follows, there will be described in detail the technical characteristics of the invention and installation, in which a burner is selected to operate with a liquid fuel, for example a fuel known by the trade name of FIOUL.

It will, nevertheless, be understood that the method is equally applicable to a burner operating with a gaseous fuel.

The method, according to the invention, is operated in and around a boiler 1, equipped with a burner 2 making use of blown air, and utilizing a liquid fuel, for example, the aforecited FIOUL. The boiler communicates with a smoke conduit 3, so that it, in turn, communicates through its output nozzle 4 with a chimney 5 through a connecting pipe 6.

The burner conventionally carries a fuel pump 7, communicating in turn, through a filter 8 with a fuel tank; air passes through a controllable air-port 9 upstream of an inlet chamber 10, a blower 11, as well as a spout 12 serving as generator for a flame in a flux of blown air, and being provided with a deflector and a flame-guide.

Conforming to the invention, the controllable air entry 9 of the burner 2 communicates by means of one or several conduits, such as 14, 15 and 16 with a multi-path corrective generator of gases 17, which in turn generates a composite gaseous flux for correction of the combustion; the injection of the latter-named flux into the burner is, in turn, controlled by a central combustion control 18 so as to arrive at an optimal setting.

According to the present method of combustion improvement, there is generated, and thereafter furnished to the burner at the entry of air, or in the vicinity thereof, or in the conduit for passage of the blown air, a complex gaseous correction means having three distinct elementary sources, which correspond, in turn, to three separate gas products furnished by the combustion-correction generator 17, and which have respective different properties, namely:

catalyst and corrosion inhibitor, neutralizer, and cleaning means, the roles and functions of which are indicated hereinafter.

The catalytic complex also serves as a corrosion-inhibitor. It triggers a principal exothermic reaction intended to increase the temperature of the flame, the calorific transfer, and also takes part in the combustion process itself. It is, in turn, associated with tension-activating components, dispersants and peptizing agents, conferring thereon properties of dispersion, detergence, anti-corrosion, and peptization, which, in turn, permit an increase in the degree of dispersion from the interior of the FIOUL droplets, and also trigger flammability of normally non-burnable constitutents, which would otherwise be difficult to set on fire.

The neutralization complex partly transforms the nitrogen-sulfur-oxides into neutral compounds without constituting any risk for any constituents of the boiler, or of the installation, and is devoid of any noxious effect on the environment. It also permits a reduction in the emission of carbon oxides. It forms a protective film on the wall or lining of the combustion chamber and exchange elements, which thus are assured of protection against all and any agressive products generated by, or resulting from the combustion.

The cleaning complex operates in sequences, starting with the detection of dirt accumulation, or degradation of performance. It permits loosening of the layer of soot, avoids hardening of an incrustating character, and guards the exchange surfaces, so as assure their clean operation and all their qualities and properties.

Hereinbelow there are recited some possible products for generation of the gaseous correcting flux.

1. Catalytic flux and corrosion-inhibitor.

A complex aqueous peroxide solution of organic metallic salts associated with tension activators, such as salts of iron, manganese, cobalt and chrome is selected.

This solution is traversed by, and subjected to a controlled air-flux bubbling therethrough, 2. Gaseous neutralizing flux.

A aqueous peroxide solution of alkaline-soil salts, such as barium salts, cerium salts, lithium salts, potassium salts, ammonium salts or equivalents thereof, is selected.

This solution is traversed by, and subjected to a controlled air-flux bubbling therethrough, 3. Gaseous cleaning flux.

This relates to a gaseous flux obtained at a time the products are generated, which, in turn, permits diminution of the fusion temperature of volatile, and normally non-burnable elements.

An aqueous peroxide solution, lightly chlorinated, and having a sodium-, potassium-, or ammonium base is selected. Its salts can be replaced by nitrates.

As far as the quantitative aspect is concerned, the burner is provided with a quantity of a gaseous complex of the order of one thousandth of the combustible air, and more particularly, as indicated hereinafter, there exists a ratio of 10 to 50 ppm in mass between the gaseous flux and the combustible fluid.

It is the task of the corrective generator of combustion 17 to deliver to the burner, conveniently dosed, the gaseous correcting complex of combustion, starting with one or several commands emanating from the central unit of optimal combustion 18, so as to render the burner and boiler operatively autonomous, i.e. with the corrective installation disconnected in the case of any malfunctioning of one of the devices of the installation for correction of the combustion process.

An interface with the central unit of optimal combustion 18 is shown in the form of a programmable automated unit 19 acting on a group of, or on individual conduits of the multi-path gaseous corrective generator 17, corresponding, in turn, to respective specific combustion correction products, which, in turn, are furnished individually, or simultaneously to the burner, in conjunction with one or the other of the distinct correction products.

As shown, each path constitutes an elementary generator, such as 20, for a specific gaseous product.

The present invention envisages in a non-limiting fashion three gaseous base products.

Each path is, for example, individually controlled by the programmable automat 19. A collective or individual air-conditioner 21 is formed with a dryer-dehumidifier compartment, such as 22, which, in turn, is followed by a low-output pump 23, each pump being associated with a respective path, and a plurality of holding tanks or bubbled-throuqh reservoirs, for example two holding tanks 24 and 25; each holding tank is filled for an identical associated path with the same solution of one of the specific products indicated hereinabove. These holding tanks or bubbled-through reservoirs are installed in series by means pipes or conduits, and terminate in a buffer reservoir 26. Each production circuit is provided, prior to the exit of the gas, with a low-flow alarm 27. Each exit communicates with the burner by means of a corresponding separate conduit, previously referred to as 14, 15 and 16, as is shown in the Figs.

The dryer 21 controls the hygrometric degree of the air, and stabilizes it at approximately 40%.

The automated unit 19 individually controls the flow of the gaseous product by the establishment and variation of the air flow at the entry or exit of the air conditioner, with the aid of the low-output blower 23, or an equivalent thereof, at each path or conduit.

A (non-illustrated) auxiliary feed-pump or blower permits reprovisioning of each container with liquid, starting from a reserve, the level of the liquid being held, for example, at a constant value with the aid of appropriate means.

Each gaseous product forming the gaseous correction complex is feebly transported in a minimal manner towards the burner by the action of the internal pump or blower 23 placed upstream of each path or conduit of the generator 17, but also, and in particular, by the negative pressure generated by the blower or turbine of the burner. In order to achieve this object, the connecting tubes to the burner are provided with outlet means in the suction chamber 10 of the burner, or in the flux of blown air within the spout 12, so as to benefit from the general air-flow entrainment.

In this manner, by means of an appropriate command from the central unit 18 via the programmed automat 19, a dose of the substance fed to the burner and sucked thereinto, can be administered along each path at will and gradually.

Because of the upstream emplacement of the blower or pump 23, the downstream reservoirs or tanks 25 and 26 are under negative pressure for both reasons of security, and so as not to foul up the other reservoirs or containers containing the aqueous solutions, or even the blower and pump itself.

The reservoirs of the aqueous solutions are equipped with level detectors, so as to avoid any useless operation of the air-blowers or pumps as result of lack of any products.

The reservoirs of the aqueous solutions are also equipped with level-loss regulators, taking into account any loss of the charges, so as to ensure by this means a regular air-flow of the blowers or air pumps.

The gas correction-circuit is also equipped with means for stopping the blowers or pumps by suppression within the conduits.

As has already been indicated, there are provided within the scope of the present invention at least three distinct conduits, corresponding, respectively, to three base products. However, this is not a limiting number, and it is possible to envisage that other conduits are provided, such as conduits for continued or momentary production, of oxydization, of vaporization, or any other supply of a product or products, the property or properties of which are within the scope and spirit of the present invention.

Conforming to the invention, the rotation speed of the blower is controlled by velocity-variation means 28, which act on a given speed-variation range provided to the entrainment motor of the burner, which is also that of the blower, without varying the feed pressure of the combustible liquid, and without intervening into the rate of heating.

This velocity regulator 28 is at any time required to modify the amount of combustible air flux sucked in, so as to correct and adapt any excess combustible air to conditions of optimal combustion. The flux from the complex gaseous corrector to the burner, which is sucked-in by the latter, is separately controlled by the central unit. The amounts of combustible air and those from the gaseous corrector vary as a function of the values, sizes and parameters monitored, with a view to maintaining optimal conditions of combustion during the total operating period of the burner.

According to a preferred embodiment, variation of the rotation velocity of the motor is obtained by means of a velocity regulator varying the frequency; the latter regulator is controlled by the central unit. The variation of the air flux extends over a range of plus/minus 10% of the pre-established value.

This variation of the entering air flux permits:

- mitigation of any excess air variations, so as to obtain a more efficient combustion, approaching the maximum of the stochiometric curve,
- reduction of suppressions due to either misfiring or misstarts,
- stabilization of interior pressures of the furnace, which are modified by natural draught variations,
- mitigation of any atmospheric variations, which modify the physical characteristics of the combustible air.

In accordance with the invention, the combustion parameters are regulated in order to lower the value of the formation point of soot and carbon oxides of the combustion parameters.

The assembly is controlled by the central processing unit 18 for optimal combustion, which is connected to the gaseous generator 17 of the gaseous flux of combustion corecting flux, to the velocity regulator 28, and to the controllable air entry 9 of the burner, but also to the diverse sensors of the principal physical values, and of the combustion parameters.

According to a variant, in order to modify the combustible air flux, it is alternately possible to also act on the opening of the controllable air entry 9 of the burner.

The sensors are disposed in diverse locations external to the boiler.

They are divided into three of the following groups:

- sensors for the burner, disposed in, or near the burner;
- sensors for the boiler;
- exit sensors placed near the connecting pipe 6 disposed at a distance from the boiler exit, equal to about 2½ the diameter of the boiler exit.

Amongst the burner sensors there are distinguished a combustible flow sensor 29, a temperature sensor 30 measuring the temperature of the combustible air, and a sensor 31, measuring the combustible air flow, or the open position of the flap for the combustible air.

Of the sensors pertaining to the boiler, it is worth mentioning in a non-limiting fashion two temperature sensors for the heat-carrying fluid. These are the entry- and exit-temperature sensors 32 and 33, respectively, of the heat-carrying fluid, which permit measurement of the temperature difference prevailing between entry and exit of the distribution circuit for the heating fluid.

Of the smoke exit-sensors it is worth mentioning a sensor 34 for the smoke temperature, a sensor 35 for measuring oxygen content, a sensor 36 for measuring contents of carbon oxides, a sensor 37 measuring carbon gas content, as well as another group of sensors 38 furnishing the content of gas pollutants, such as sulfur anhydride and its components, and nitrogen oxide and its components. A last sensor 39 permits measurement of the opacity of the smoke.

The parameters monitored are those bearing on the quality, efficiency, and cleanliness of the combustion process.

The central unit 18 of optimal combustion controls, on one hand, with a calculator-regulator 40, for example a microprocessor, on one hand, the rotation speed of the blower motor, i.e. it acts on the flux of combustible air, so as to permit the dosage of excess air, which plays such an important role in the formation of nitrogen oxides, but controls also, on the other hand, according to a variant of the invention, the rate of mixture of the combustible air with the gaseous combustion correcting complex. In accordance with the values of the parameters monitored, according to one rule of regulation and correction; in this respect it permits at all times maintenance of optimal conditions of combustion during operation of the burner.

The ratio of the mass of catalysts compared to that of the combustibles is within the range of 10 to 50 ppm.

The flux of the gaseous correcting complex is determined principally by the following considerations:

the enrichment capacity of the air with respect to the humidity present at the output of the dehumidifier, taking into account the aqueous solutions which the air must traverse, the speed of passage of the gaseous correction complex, which in turn is a function of the air sucked in by the action of burner turbine.

The necessary total flux of the gaseous correcting complex determines in turn the number of generator circuits of the gaseous complex, which are to be put into service, on the basis of an average of 200 liters/hour per circuit for a fuel consumption equal to 30 KW/hour.

The above method can be made use of in a simplified manner, in which mode of utilization the correction means include only the generator of the gaseous correction flux 17, controlled by the programmable automated unit 19 operating in accordance with the combustible flux, the flux of combustible air, and the smoke temperature, the values thereof being measured by respective of the corresponding probes, as has been indicated hereinabove.

According to the simplified process, the variation of the flux of combustible air is controlled by the blower motor only, in accordance with the flux of the combustible matter and the temperature of the smoke.

During the ignition and heating-up stage until attainment of a stable condition, there will be utilized those production circuits of the gaseous complex, whose aqueous solutions are composed of, or include a support, such as a light topping of gas/oil, which is made soluble by a catalyzer, such as, for example, salts of cobalt, or manganese, or nickel, or iron, or chrome, or cerium, or mixtures or compositions of one or the other of the aforesaid salts.

Such a treatment is also adapted to operation with a low rate of combustion, for which case the addition of a gaseous combustion corrector to the combustible air permits a notable reduction of the production of volatile materials and of non-burnable gas.

During a phase of stronger combustion or of a stable state, those circuits will be utilized whose aqueous solutions are composed of mixtures of metallic salts together with compounds of chlorine, such as ammonium chloride or potassium chloride.

It will be recalled that the method, according to the present invention, permits reduction of excess air, leading in turn to a corresponding reduction of nitrogen oxides, which, due to the aforesaid process, are transformed into nitrates, while still maintaining optimum combustion.

It will be further recalled that the method, according to the present invention, is applicable to any combustion process, whether of a solid, liquid, or gaseous fuel.

It is furthermore possible to envisage use of the above-described method for other applications, such as treatment of odors resulting from combustion processes, from pyrolyses, from firing processes, or from other sources releasing gases.

It will be understood that in addition to the means described, diverse obvious modifications and simple variants thereof enter into the scope of the present invention.

I claim:

1. A method for achieving optimal combustion, comprising the steps of:

providing a boiler with a blower-type burner having a variable speed blower;

providing combustive air to said burner;

providing a gaseous combustion-correcting complex for supplying a plurality of gaseous additives to said combustive air within said burner;

providing sensors within said burner, within said boiler, and within a discharge outlet of said boiler; and providing a central unit, operatively connected to said sensors, for controlling the speed of said variable speed blower of said burner and the operation of said gaseous combustion correcting complex for providing predetermined amounts of said gaseous additives to said combustive air in response to signals received by said central control unit from said sensors disposed within said burner, within said boiler, and within said discharge outlet of said boiler.

2. The method according to claim 1, wherein:

the supply of said gaseous complex to said combustive air is obtained by varying the speed of said blower of said burner.

3. The method according to claim 1, characterized by the combustion correction complex being a mixture of a gaseous catalytic flow, and of a gaseous flow inhibiting corrosion, and sequentially thereafter of a gaseous cleansing flow.

4. The method according to claim 1, characterized by the regulation of combustion conditions being carried out to just below a point of formation of soot and carbon oxide.

5. The method according to claim 3, characterized by the gaseous complex sequentially containing a gaseous neutralization flux with respect to sulfurous and sulfuric anhydride.

6. The method according to claim 3, characterized by the gaseous flux for catalysis and inhibition of corrosion, being obtained by causing a flux of air to bubble through a peroxidized aqueous solution of organo-metallic salts associated with tension-activating products.

7. The method according to claim 5, characterized by the gaseous neutralizing flux being obtained by causing a flux of air to bubble through a peroxidized aqueous solution of alkaline earth salts.

8. The method according to claim 5, characterized by the gaseous neutralizing flux being obtained by causing a flux of air to traverse a peroxidized aqueous solution which is lightly chlorinated, and having a sodium-, potassium-, or ammonium base.

9. The method according to claim 1, wherein during the ignition and heating-up phase until the attainment of a stable state, production circuits of said gaseous complex are utilized, the aqueous solutions of which comprise a support, such as a light topping of gas/oil which, in turn, has been made soluble within a catalyzer which is selected from the group of salts of cobalt, manganese, nickel, iron, chrome, cerium, and mixtures of one or more of said salts.

10. The method according to claim 1, wherein said combustive air is controlled in accordance with a predetermined fuel flow rate within said burner and a predetermined smoke temperature within said discharge outlet.

11. Apparatus for achieving optimal combustion, comprising:

a boiler having operatively associated therewith a blower-type burner having a variable speed blower;

means for providing combustive air to said burner;

a gaseous combustion-correcting complex for supplying a plurality of gaseous additives to said combustive air within said burner;

a plurality of sensors disposed within said burner, within said boiler, and within a discharge outlet of said boiler; and a central unit, operatively connected to said sensors, for controlling the speed of said variable speed blower of said burner and the operation of said gaseous combustion-correcting complex for providing predetermined amounts of said gaseous additives to said combustive air in response to signals received by said central unit from said sensors disposed within said burner, within said boiler, and within said discharge outlet of said boiler.

12. Apparatus as set forth in claim 11, wherein said gaseous combustion-correcting complex comprises:

a plurality of independent gaseous generators;

air conditioning means operatively connected to and feeding said plurality of generators;

each one of said generators comprising a plurality of gaseous reservoirs serially connected together by gaseous-additive flow conduits and wherein an upstream one of said plurality of reservoirs is fluidically connected to said air conditioning means, while a downstream one of said plurality of reservoirs is fluidically connected to a low-flow alarm; and a programmable automat interposed between said central unit and said plurality of generators for individually controlling said generators.

13. Apparatus as set forth in claim 11, wherein:

said sensors disposed within said burner comprise a combustible flow sensor, a temperature sensor for measuring the temperature of the combustive air, and a sensor for measuring the combustive air flow.

14. Apparatus as set forth in claim 11, wherein:

said sensors disposed within said boiler comprise entry and exit temperature sensors for measuring the temperature difference prevailing between entry and exit positions of said boiler as the heat-carrying fluid traverses said boiler.

15. Apparatus as set forth in claim 11, wherein:

said sensors disposed within said discharge outlet of said boiler comprise a smoke temperature sensor, an oxygen content sensor, a carbon oxide sensor, a carbon gas sensor, a gas pollutant sensor, and a smoke opacity sensor.

* * * * *